US006003158A

United States Patent [19]

Yu

[11] Patent Number: 6,003,158

[45] Date of Patent: Dec. 21, 1999

[54] AUTOMATIC CLEANING DEVICE FOR TOILET SEATS

[76] Inventor: Yi-Chieh Yu, P.O. Box 82-144, Taipei, Taiwan

[21] Appl. No.: 09/035,351

[22] Filed: Mar. 5, 1998

[51] Int. Cl.[6] ..... A47K 13/30

[52] U.S. Cl. ..... 4/233

[58] Field of Search ..... 4/233

[56] References Cited

U.S. PATENT DOCUMENTS

| | | | |
|---|---|---|---|
| 3,599,246 | 8/1971 | Bramati | 4/233 |
| 4,536,899 | 8/1985 | Sehnyder | 4/233 |
| 4,734,942 | 4/1988 | Blanchard | 4/233 |
| 4,790,036 | 12/1988 | Yogeli et al. | 4/233 |
| 5,806,105 | 9/1998 | Yu | 4/233 |

*Primary Examiner*—Charles E. Phillips
*Attorney, Agent, or Firm*—A & J

[57] ABSTRACT

Disclosed is an automatic cleaning device for toilet seats. A motor drives upper and lower transmission gear sets. The upper transmission gear set, after reduction, drives a scrub disk, while the lower transmission gear set has a main gear in front to engage a toothed ring at the inner ring of the toilet seat. The turning of the main gear enables the toilet seat to rotate about 360 degrees. Another motor drives a lateral gear set to further drive a drag mechanism. When the two cantilever arms of the drag mechanism swing, the link arms at a lower end will drive a drag block which has two slide blocks.

3 Claims, 10 Drawing Sheets

AUTOMATIC CLEANING DEVICE FOR TOILET SEATS

BACKGROUND OF THE INVENTION

1.Field of the Invention

The present invention relates to an automatic cleaning device for toilet seats.

2.Description of the Prior Art

People are hesitant to use public toilets because they are not sanitary. Attempts have been made to overcome this problem. There has been provided stacks of tearable plastic film or tissue paper for use on the toilet seats. But up to now, there has not been developed a kind of automatic cleaning device that can clean and antisepticize the toilet seat at the same time.

SUMMARY OF THE INVENTION

The present invention relates to an automatic cleaning device for toilet seats.

A primary object of the present invention is to provide an automatic cleaning device for toilet seats.

According to the present invention, a motor drives an upper gear seat and a lower gear set. After reduction, the upper gear set may rotate a scrub disk, whereas the lower gear set has a main gear engaging an inner ring of the toilet seat, whereby the rotation of the main gear allows the toilet seat to rotate through 360 degrees.

Another motor is provided to drive a lateral gear set which further drives a dragging mechanism. When the cantilever arms of the dragging mechanism are swung, a link arm below will drive a drag block which has two slide blocks. The two slide blocks are respectively clamped at both sides of a slide pillow mechanism. The drag block has two rollers which may fit into a rear frame of the toilet seat. When the cantilever arms are rotated, the toilet seat will be brought to horizontally displace to the front or the back.

There is further provided an antiseptic box which is connected to a hollow rotary shaft of the scrub disk by means of a hose, so that antiseptic liquid may flow into the scrub disk. There is further provided a dryer with a nozzle orienting towards the surface of the toilet seat to dry the surface of the toilet seat.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
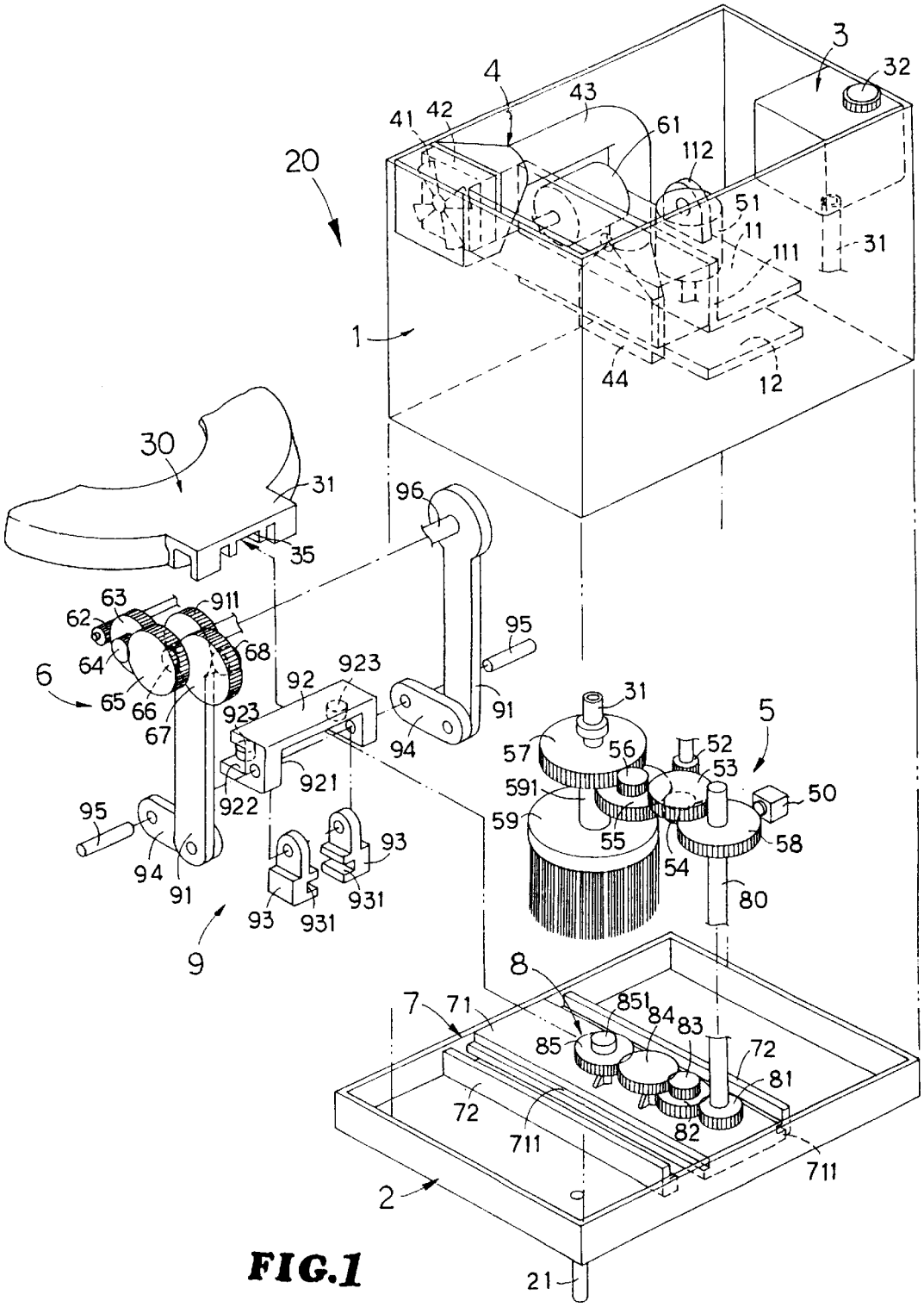
FIG. 1 is a perspective exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

The present invention will now be described with reference to the embodiment shown in the drawings.

Figure 2:
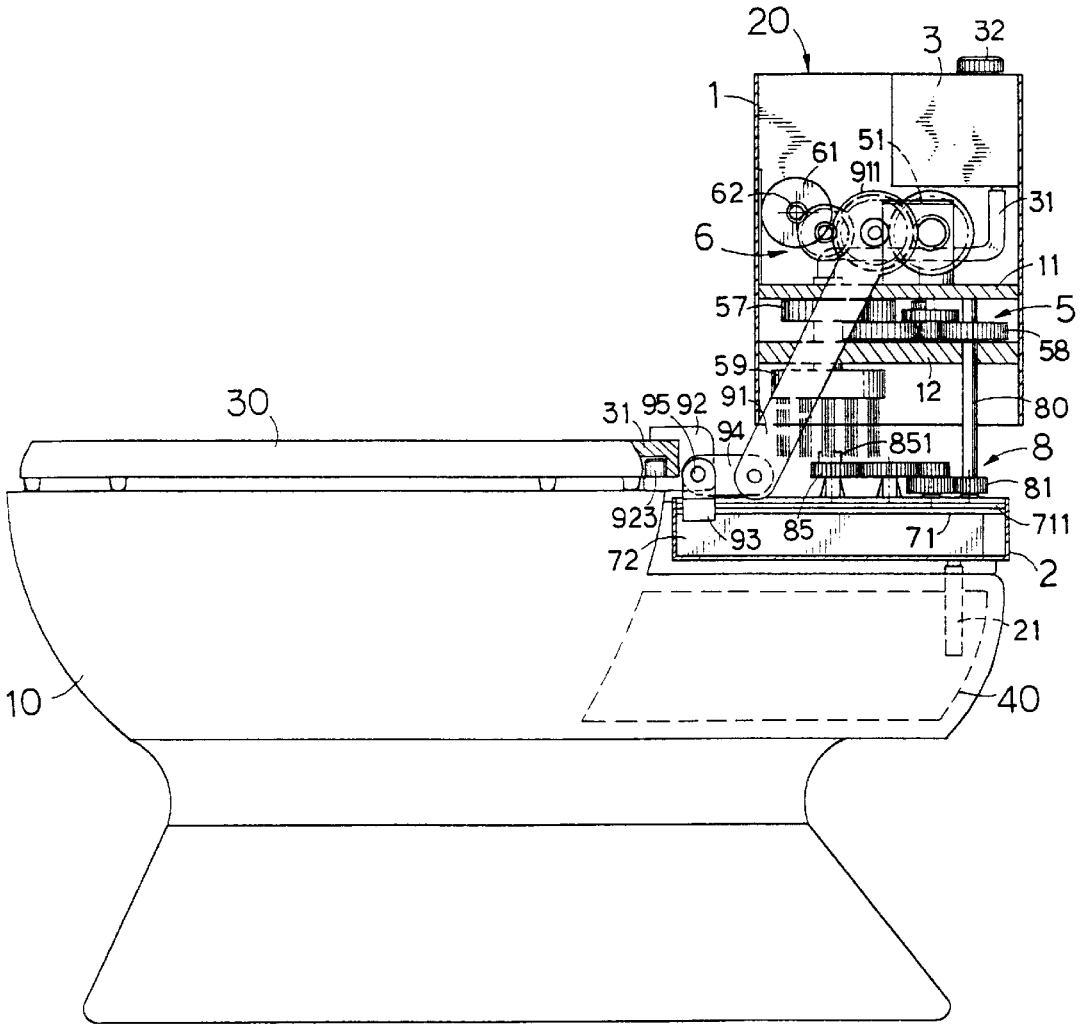
FIG. 2 is a side view of the present invention.

FIG. 1 is a perspective exploded view of the toilet seat automatic cleaning device of the present invention. With further reference to the side view in FIG. 2, the rear end of a toilet bowl 10 is provided with an automatic cleaning device 20 which comprises: a container 1 located at an upper side behind the toilet bowl 10; a water tray 2 located below the container 1; an antiseptic box 3 and a dryer 4 disposed inside the container 1; upper and lower boards 11, 12 provided at the center of the container 1; two motors 51, 61 disposed on the upper board 11; a transmission gear set 5 provided between the upper and lower boards 11 and 12; a gear set 6 provided laterally of the upper board 11; a slide pillow mechanism 7 comprised of a slide pillow and two side clamp blocks 72 provided in a water tank 2; a transmission gear unit 8 provided on the surface of the slide pillow; and a dragging mechanism comprised of a pair of cantilever arms 91, link arms 94, a drag block 92, and two slide blocks 93. Furthermore, there is a space between the container 1 and the water tray 2 such that the space is sufficient to allow the horizontal entry and exit of a toilet seat 30.

Figure 3:
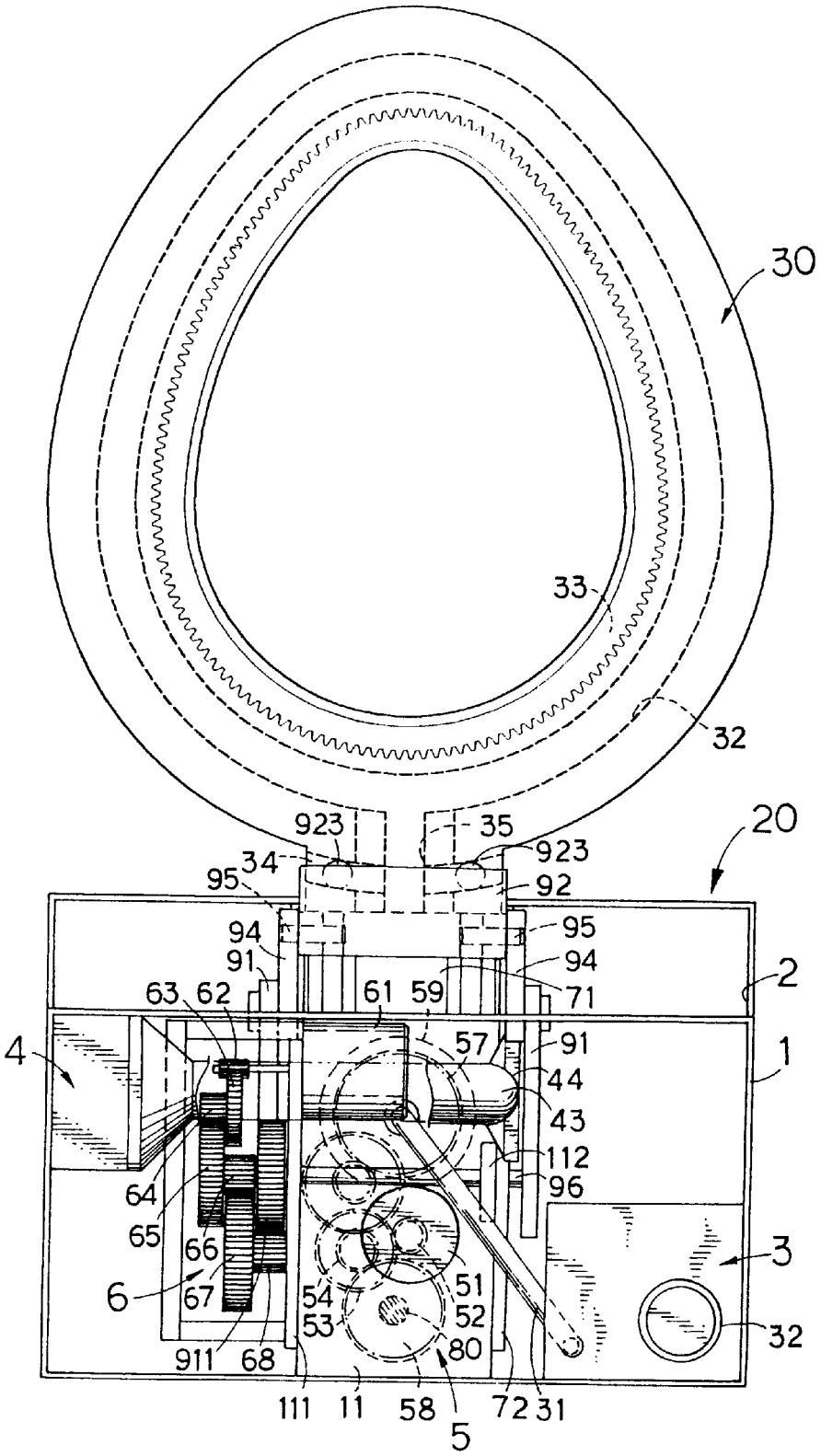
FIG. 3 is a top view of the present invention (the lower gear set not being shown)

The above-mentioned motor 51 may actuate the transmission gear set 5 (including seven driven gears 52–58 of various sizes, as shown in FIG. 3) on the upper board 11, in which the end gear 57 is coaxial with a scrub disk 59 so that the latter may be rotated thereby. The transmission gear set 5 includes an intermediate gear 58 which is coaxial with an initial gear 81 of the transmission gear unit 8 on the slide pillow. The initial gear 81 may, through driven gears 82–84 of various sizes, drives an end gear 85 (see FIG. 4). The end gear is a main gear that rotates the toilet seat 30 and has a projecting shaft 851 on the spindle thereof.

The motor 61 drives the gear set 6 (including seven driven gears 62–68 of different sizes), in which the end gear 68 is engageable with a toothed ring 911 at an upper end of the cantilever arm 91 to thereby rotate the cantilever arm at a high speed. The upper ends of the two cantilever arms are connected with a horizontal shaft 96 which is pivotally at both sides of a side board 111 and a side block 112 of the upper board 11. The lower ends of the cantilever arms are pivotally connected to the link arms 94. The other end of each link arm 94 is coupled to the drag block 92 and the corresponding slide block 93 by a pin 95. The two slide blocks 93 are disposed in a rear frame recess 921 of the drag block 92. The inner side of the lower end of each slide block has a clamp portion 931 for engaging the projections 711 at both sides of the slide pillow 71. Since the slide blocks 93 are stopped at both sides by the clamp blocks 72, the slide pillow 71 and the clamp blocks 72 at both sides thereof together define a track to allow the slide blocks 93 to slidably displace horizontally along the track. The drag block 92 further has a front frame recess 922, and a roller 923 is provided at each side of the front frame recess 922. The two rollers 923 may fit into a projecting frame 31 at the rear end of the toilet seat 30 for dragging purposes.

Figure 4:
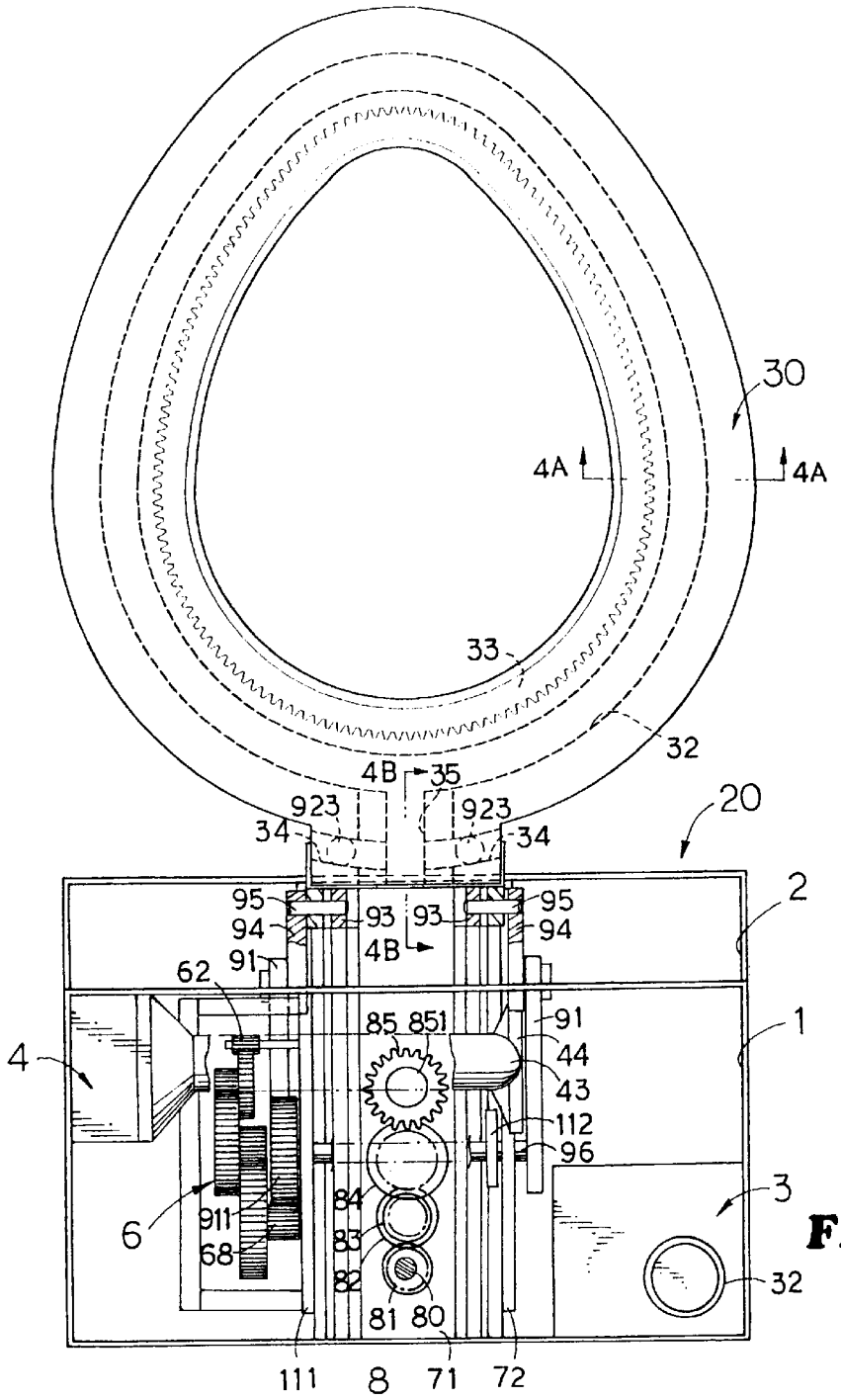
FIG. 4 is a bottom view of the present invention (the upper gear set not being shown)
Figure 4A:
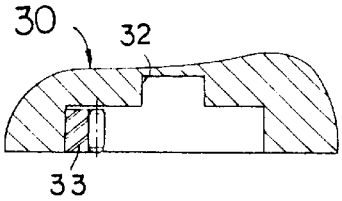
FIG. 4A is a sectional view taken along line 4A—4A of FIG. 4.
Figure 4B:
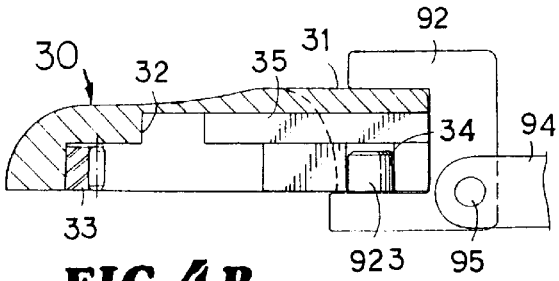
FIG. 4B is a sectional view taken along line 4B—4B of FIG. 4.
Figure 5:
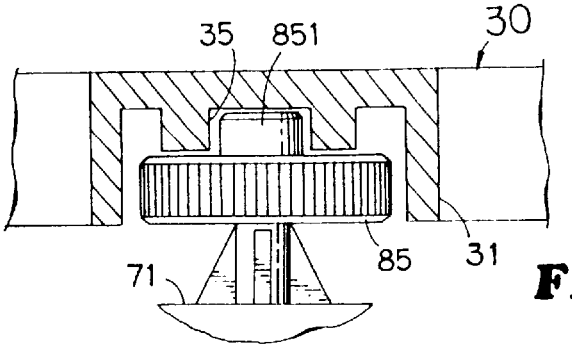
FIG. 5 is a sectional view of the toilet seat having a rear frame with a main gear.

FIGS. 3 and 4 shows that the center of the bottom side of the toilet seat 30 has a substantially inverted T-shaped annular groove 32 (see FIG. 4A), and a toothed ring 33 is provided at the inner ring on the bottom side. The projecting frame 31 at the rear end of the toilet seat has a curved groove 34 (for receiving the rollers 923 of the drag block 92). A guide slot 35 (see FIG. 4B) with a substantially inverted T-shaped opening is disposed between the bottom edge and the annular groove 32. The guide slot 35 allows entry of the gear set unit 8 into the toilet seat 30 (see FIG. 5).

Figure 6:
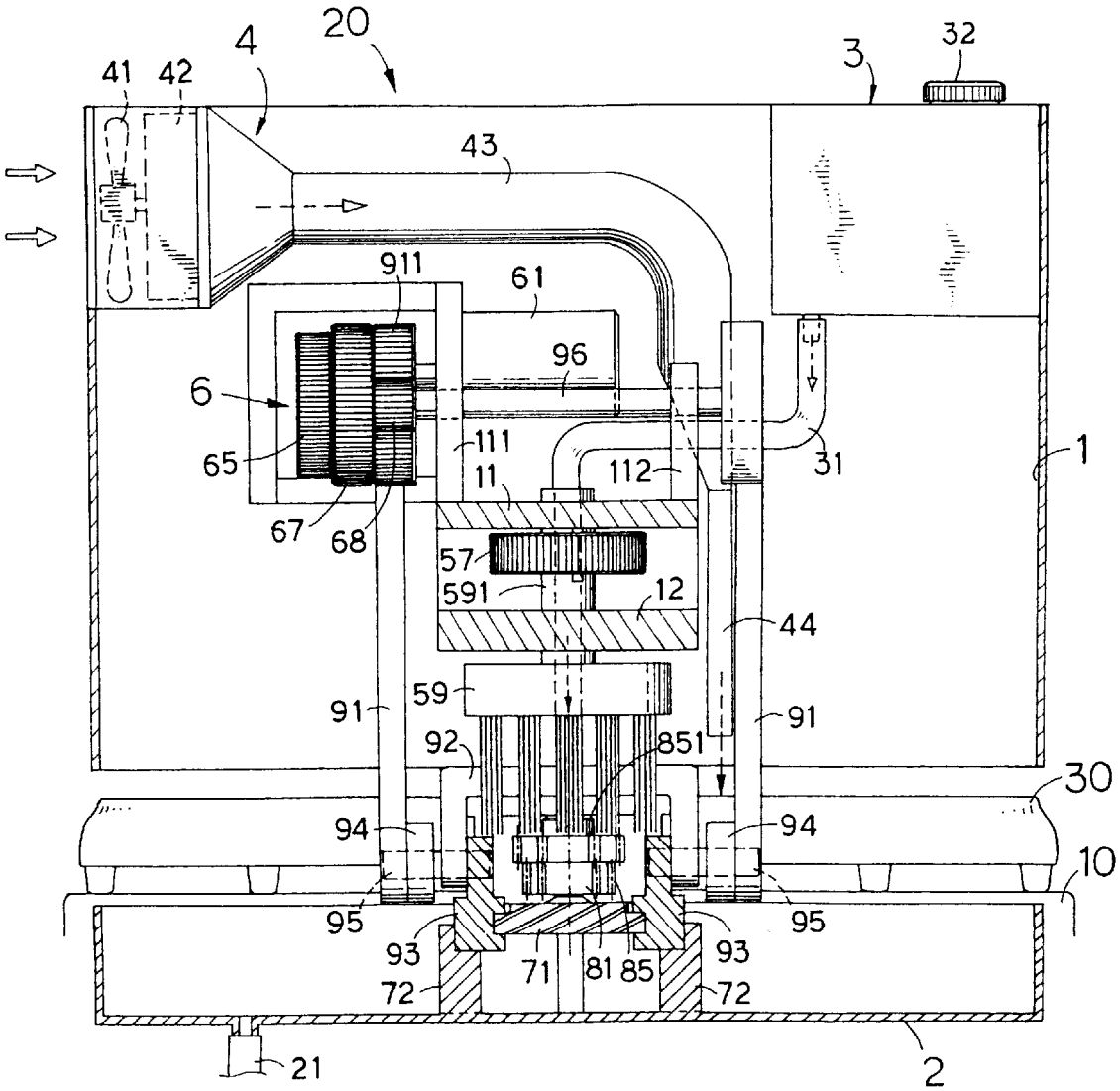
FIG. 6 is a rear view of the present invention.

Referring to FIG. 6, which shows a rear view of the automatic cleaning device of the present invention (wherein the motor 51 and the transmission gear set 5 have been removed), the antiseptic box 3 is provided at a corner at the upper end of the container 1. A hose 31 connects the bottom end of the antiseptic box 3 to an upper end of a hollow rotary shaft 591 of the scrub disk 59 so that the antiseptic may be discharged with the rotation of the scrub disk 59. The output of the antiseptic is controllable by a flow control valve. The antiseptic box 3 is provided with an opening 32 at an upper end for refill of antiseptic. The discharged antiseptic will automatically flow into the water tray 2 and into the water tank 40 via a duct 21 (see FIG. 2). The dryer 4 is provided at another corner at the upper end of the container 1 and includes a fan 41 and a heater 42. An air discharge tube 43 connects a sector-shaped nozzle 44 at the rear end. The nozzle 44 has a flat narrow opening so that the hot air may be concentrated and then distributed to the toilet seat 30 to achieve drying.

Figure 7:
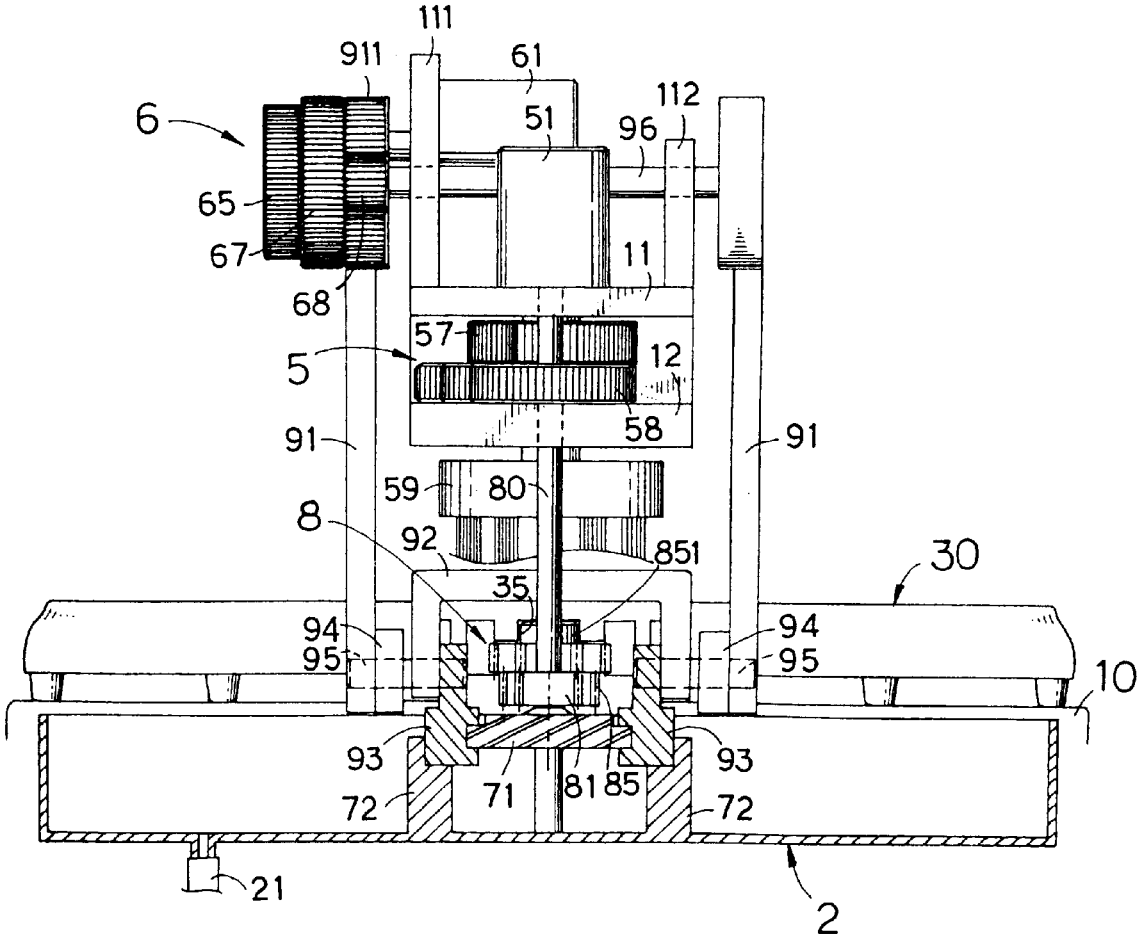
FIG. 7 is a rear view of the three gear sets of the present invention.

FIG. 7 is a rear view of the transmission mechanism of the present invention. As shown in FIG. 7, the motor 51 drives the transmission gear set 5 on the upper board to indirectly drive the scrub disk 59 and the gear set 6 below. The motor 61 drives the gear set 6 to actuate the cantilever arms 91 and further the link arms 94, the drag block 92, and the slide blocks 93. Since the slide blocks 93 are provided in the track defined between the slide pillow 71 and the clamp blocks 72 at both sides thereof, they may smoothly slidably displace along the track to enable the toilet seat 30 may move in a stable manner.

Figure 8:
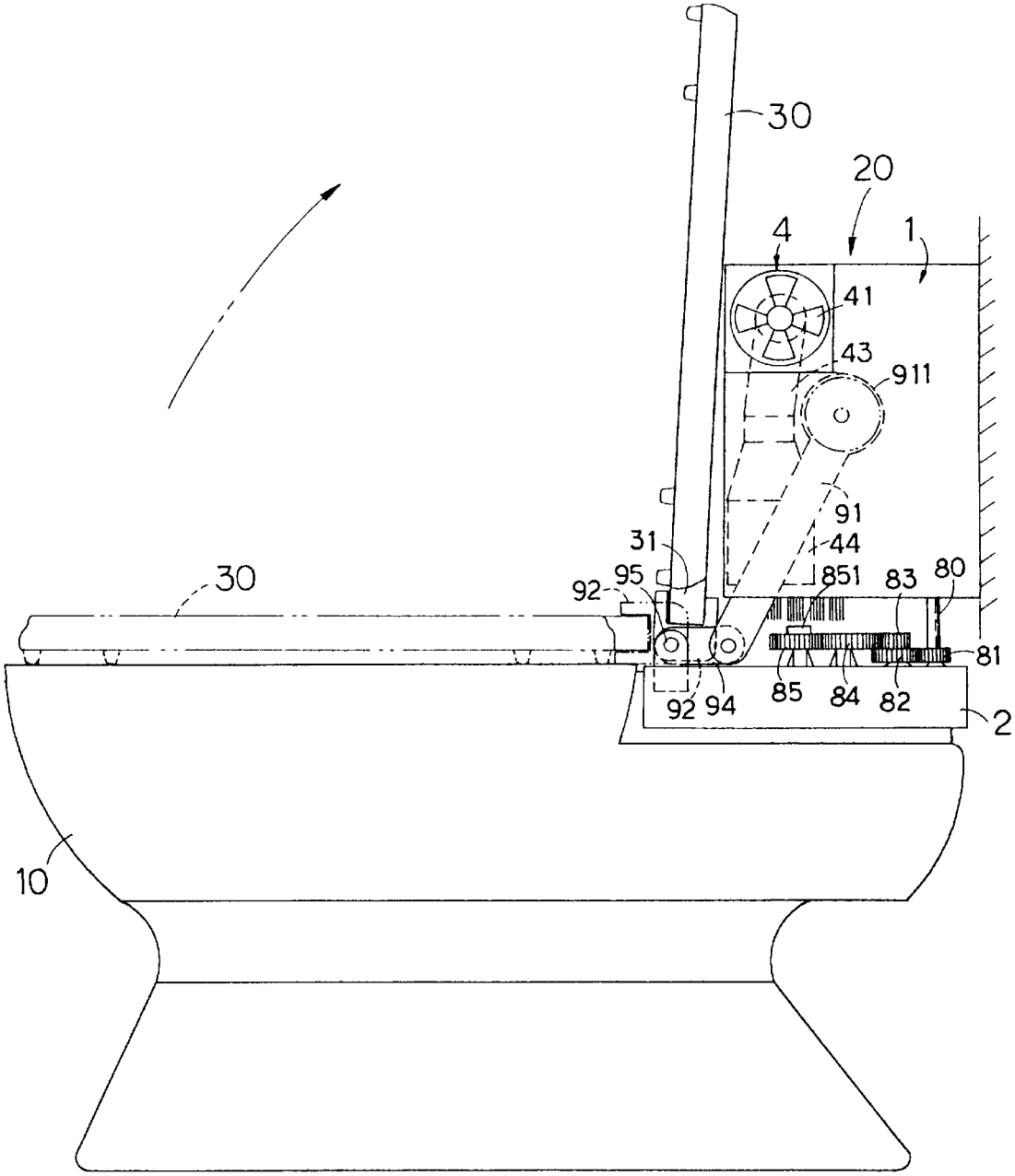
FIG. 8 is a schematic view illustrating the lifting up of the toilet seat.

Referring to FIG. 8, which shows the toilet seat of the invention in an uplifted state, when the user wants to lift the toilet seat 30, the toilet seat 30 will use the pins 95 of the drag block 92 as rotary shafts and rotate.

Figure 9:
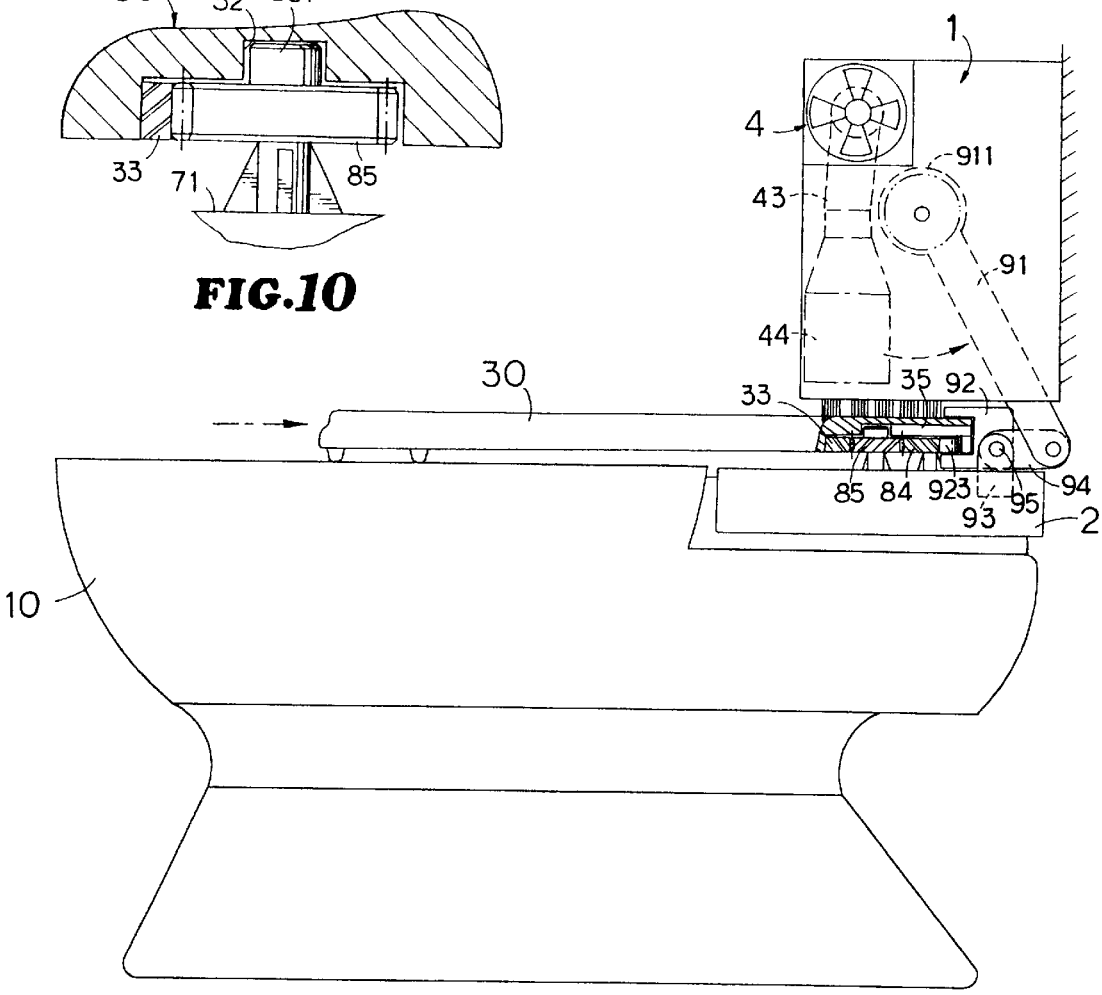
FIG. 9 is a side view illustrating the rearward displacement of the toilet seat.
Figure 9A:
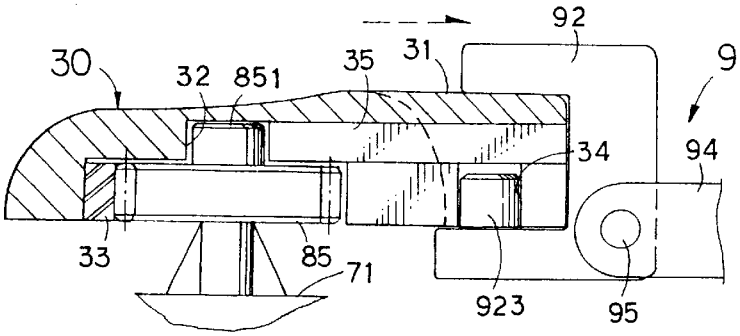
Figure 12:
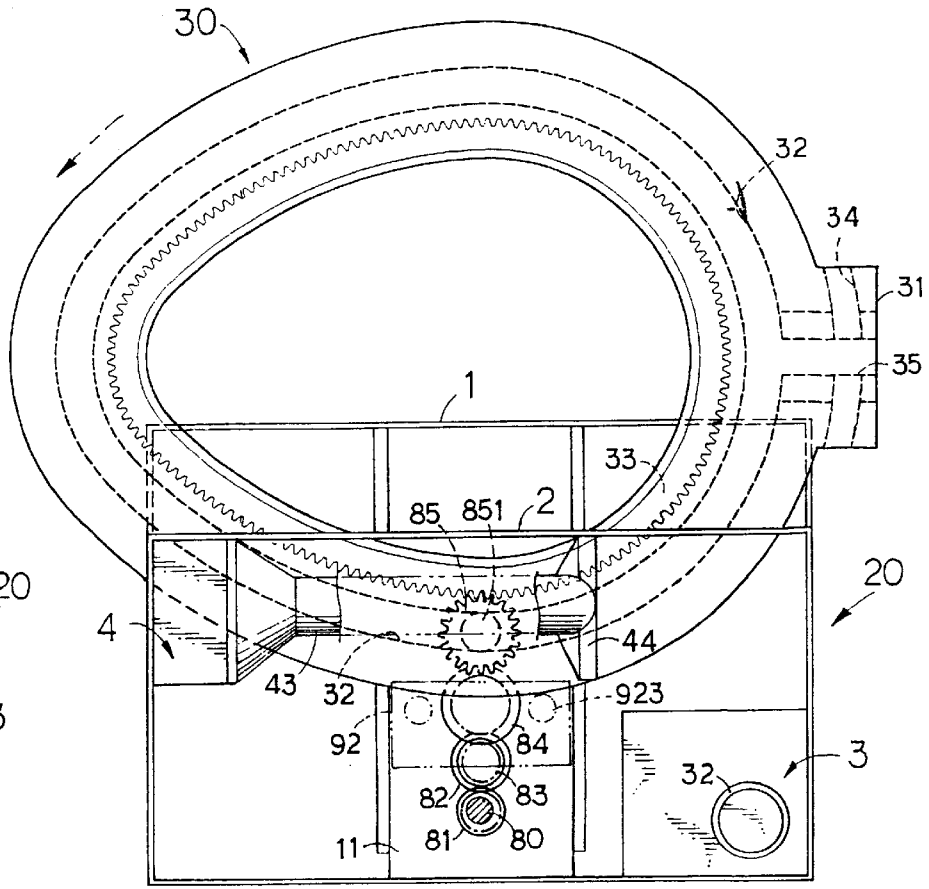
FIGS. 11–14 are schematic views illustrating the continuous movement of the toilet seat when it rotates.
Figure 11:
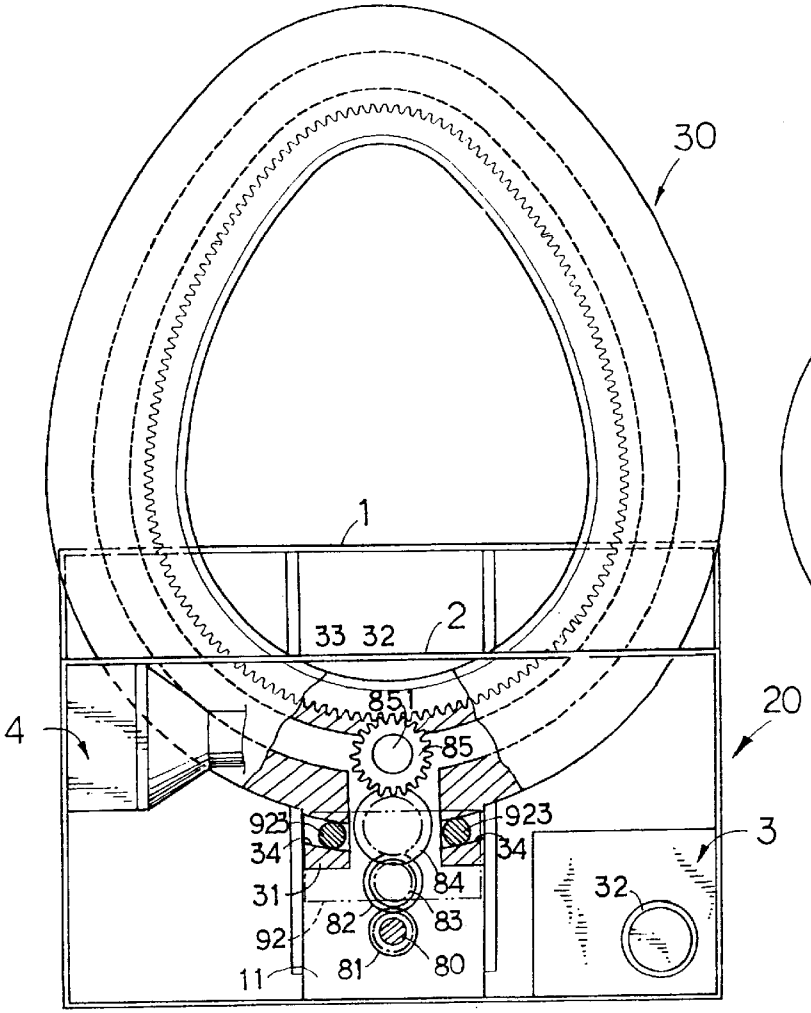
Figure 14:
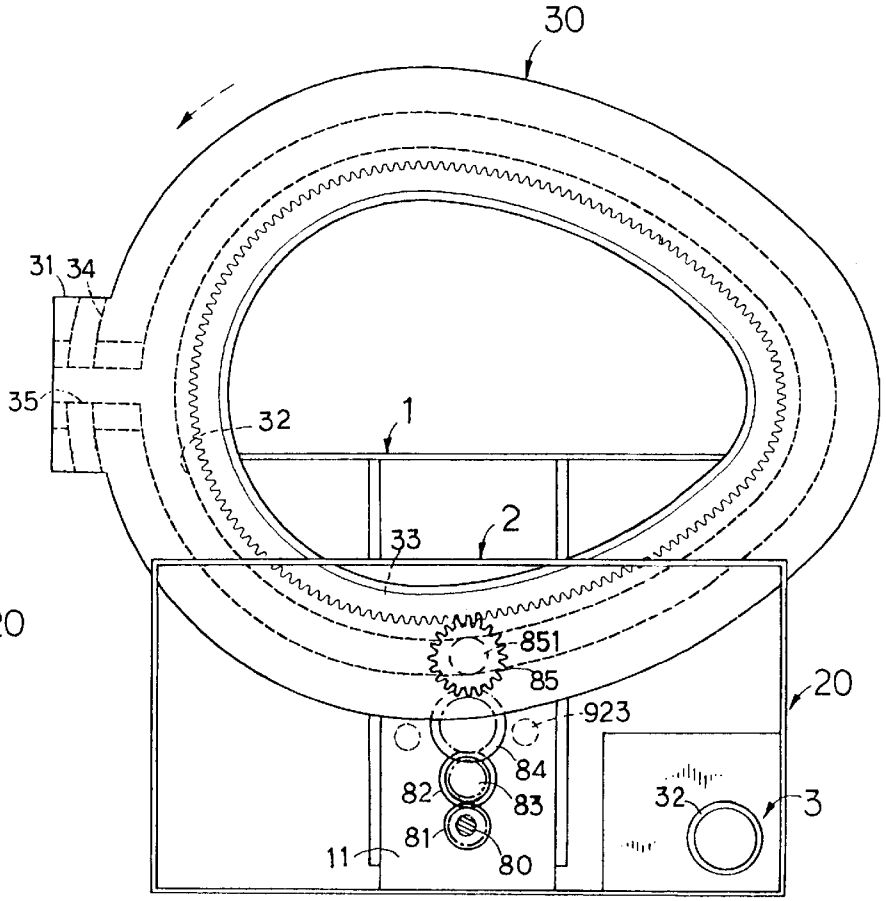
Figure 13:
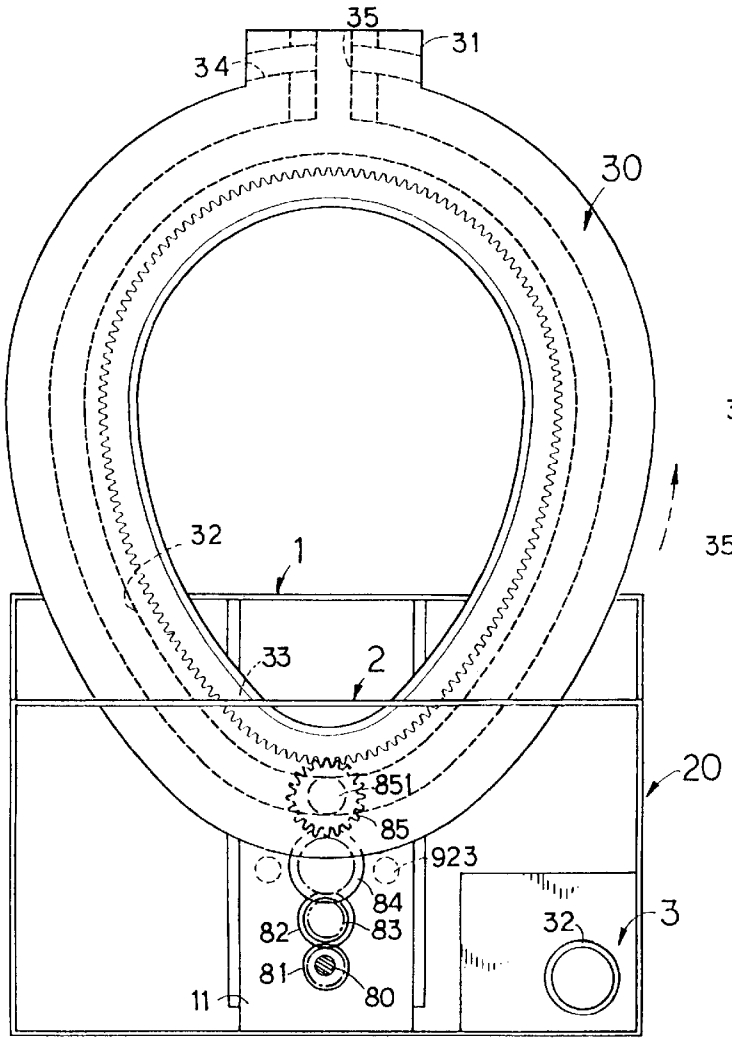

With reference to FIG. 9, which shows operation of the toilet seat, when the cantilever arms 91 swing rearwardly, the rollers 923 of the drag block will drag the toilet seat 30 to horizontally displace to the rear, while the main gear 85 will follow the guide slot 35 of the toilet seat 30 into the annular groove 32 (see FIG. 9A) to engage with the toothed ring 33. When viewed from the top, as in FIG. 11, the main gear 85 passes through the guide slot 35 of the toilet seat 30 and then engages the toothed ring 32.

Figure 10:
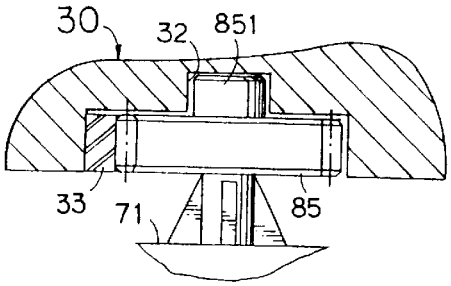
FIG. 10 is a sectional view of the main gear inside the toilet seat.

When the main gear 85 rotates, it brings the toilet seat 30 to rotate therewith as well. The annular groove 32 in the toilet seat will follow the projecting shaft 851 of the main gear 85 to rotate rhythmically (see FIG. 10). The process of rotation is illustrated in FIGS. 11–14. During horizontal rotation, the scrub disk 59 will quickly scrub the toilet seat while the antiseptic is flowing out of the septic box. At the same time, the dryer 4 will dry the surface of the toilet seat 30 with hot air and cause the antiseptic on the toilet seat 30 to quickly evaporate. In the present invention, rotation, scrubbing, applying antiseptic and drying may be achieved in a single automatic operation.

The user may operate the present invention by pressing a switch, and one turn of the toilet seat is controllable by an integrated circuit or a time limit relay. In addition, in order to prevent the user from damaging the automatic cleaning device 20 by sitting down on the toilet seat 30 during rotation, a photoelectric switch 50 is further provided on the intermediate gear 58 (see FIG. 1). When the toilet seat 30 is being pressed and stopped, the photoelectric switch 50 will immediately sense the pressure and stop the action of the motor 51 until the pressure is released. Furthermore, when the toilet seat 30 is dragged horizontally back and forth, if there is a load pressing down thereon, a circuit will sense the pressure and stop the motor 61 until the load is released.

The present invention has the following effects and advantages: The toilet seat may be automatically antisepticized, scrubbed, and dried in a single operation. The toiletN seat is kept sanitary so that the users need not worry when using the toilet. The present invention is convenient to use and easy to operate.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An automatic cleaning device for toilet seats, comprising:

a container located behind a toilet bowl at an upper side;

a water tray located below said container;

an antiseptic box disposed inside said container;

a dryer disposed inside said container;

upper and lower boards disposed in the center of said container; two motors mounted on said upper board;

an upper transmission gear set mounted between said upper and lower boards;

a gear set provided laterally of said upper board;

a slide pillow mechanism provided in a water tank and comprised of a slide pillow and two clamp blocks at each side of said slide pillow;

a lower transmission gear set provided on the surface of said slide pillow; and a drag mechanism comprised of two cantilever arms, two link arms, a drag block, and two slide blocks, wherein there is a space between said container and said water tray such that said space is sufficient to allow horizontal entry and exit of a toilet seat therethrough, said toilet seat having a projecting frame at a rear end thereof, and a substantially inverted T-shaped annular groove at the center of a bottom side thereof, an inner ring being provided with a toothed ring, said projecting frame having a curved groove at a bottom end thereof, a substantially inverted T-shaped guide slot being disposed between a bottom edge and said annular groove;

one of said motors drives said upper transmission gear set to further drive a scrub disk, said upper transmission gear set including an intermediate gear which is coaxial with an initial gear of said lower transmission gear set to thereby drive said lower transmission gear set, said lower transmission gear set including a main gear at a front end thereof, said main gear having a projecting shaft, said main gear being engageable with said toothed ring of said toilet seat said projecting shaft being guided into said annular groove of said toilet seat;

the other of said motors drives said gear set disposed laterally of said upper board, said gear set including an end gear engageable with a toothed ring at an upper end of one of said cantilever arms, the upper ends of said cantilever arms being connected to a horizontal shaft and pivotally mounted at both sides of said upper board, the lower ends of said cantilever arms being pivotally connected to one end each of said link arms, said link arms being pivotally connected to said drag block and said slide blocks by pins; and said slide pillow in said water tray extends to form projections, said slide pillow and said clamp blocks at both sides thereof together defining a double track in which said slide blocks are disposed, said water tray further having a discharge tube for discharging residual antiseptic into the water tank.

2. The automatic cleaning device as defined in claim 1, wherein said antiseptic box has a hose connecting a bottom end thereof to an upper end of a hollow rotary shaft of said scrub disk to allow antiseptic to flow into said scrub disk.

3. An automatic cleaning device as defined in claim 1, wherein said drag block has a rear frame recess for receiving said slide blocks and a front frame recess that has a roller at either side thereof, said rollers fitting into said projecting frame at the rear end of said toilet seat for dragging purposes.

* * * * *